US006479940B1

(12) United States Patent
Ishizuka

(10) Patent No.: US 6,479,940 B1
(45) Date of Patent: Nov. 12, 2002

(54) ACTIVE MATRIX DISPLAY APPARATUS

(75) Inventor: Shinichi Ishizuka, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/662,347

(22) Filed: Sep. 14, 2000

(30) Foreign Application Priority Data

Sep. 17, 1999 (JP) ..... 11-263735

(51) Int. Cl.[7] ..... G09G 3/10
(52) U.S. Cl. ..... 315/169.3; 345/76; 345/207
(58) Field of Search ..... 315/169.1, 169.3; 345/207, 214, 55, 76, 77

(56) References Cited

U.S. PATENT DOCUMENTS 4,242,679 A * 12/1980 Morozumi et al. ..... 340/765
6,035,180 A * 3/2000 Kubes et al. ..... 455/90
6,091,203 A * 7/2000 Kawashima et al. ..... 315/169.3
6,229,505 B1 * 5/2001 Fujii ..... 345/76

FOREIGN PATENT DOCUMENTS

JP 8-241057 9/1996

* cited by examiner

*Primary Examiner*—Don Wong
*Assistant Examiner*—Thuy Vinh Tran
(74) *Attorney, Agent, or Firm*—Morgan, Lewis & Bockius LLP

(57) ABSTRACT

An active matrix display apparatus includes a light-emitting panel including a plurality of light-emitting devices arranged in a matrix configuration and driving devices for selectively allowing each of the plurality of light-emitting devices to emit light. A control circuit is provided for controlling the driving devices in accordance with an input video signal. A light adjustment signal generating circuit for generating a light adjustment signal to designate a display luminance of the light-emitting panel. A variable power source supplies an electric power variable with a magnitude according to the light adjustment signal to the plurality of light-emitting devices.

10 Claims, 8 Drawing Sheets

ACTIVE MATRIX DISPLAY APPARATUS

BACKGROUND OF THE INVENTION

1. Field of the Invention

The present invention relates to an active matrix display apparatus and, more particularly, to a display apparatus using an active matrix light-emitting panel having a light-emitting device such as an organic electroluminescence device.

2. Description of the Related Art

In an organic electroluminescence device (hereinafter, referred to as an organic EL device), the light emission luminance can be controlled by a current which flows through the light-emitting device. A matrix type display is being widely developed using a light-emitting panel having a plurality of light-emitting devices arranged in a matrix configuration. There are a simple matrix light-emitting panel and an active matrix light-emitting panel as light-emitting panels having the organic EL devices. The organic EL devices are merely arranged in a matrix configuration in the simple matrix light-emitting panel. On the other hand, a driving device including a transistor is added to each of the organic EL devices arranged in a matrix configuration in the active matrix light-emitting panel. The active matrix light-emitting panel has advantages such that an electric power consumption is smaller and an amount of crosstalk between pixels is smaller as compared with those of the simple matrix light-emitting panels and the like and, particularly, is suitable as a display of a large screen or a high precision display.

FIG. 1 shows an example of a circuit configuration corresponding to one pixel 10 of a conventional active matrix light-emitting panel. The circuit configuration is disclosed in, for example, Japanese Patent Application Kokai No.8-241057.

In FIG. 1, a gate G of an FET (Field Effect Transistor) 11 (i.e., a transistor for selecting an address) is connected to an address scan electrode line (i.e., an address line) to which an address signal is supplied. A source S of the FET 11 is connected to a data electrode line (i.e., a data line) to which a data signal is supplied. A drain D of the FET 11 is connected to a gate G of an FET 12 (i.e., a transistor for driving) and connected to the ground via a capacitor 13. A source S of the FET 12 is connected to the ground and a drain D is connected to a cathode of an organic EL device 15 and connected to a power source via an anode of the organic EL device 15. The light emission control operation of the circuit mentioned above will be described below.

When an ON voltage is supplied to the gate G of the FET 11 in FIG. 1, a data voltage is supplied to the drain D. When the gate G of the FET 11 is at an OFF voltage, the FET 11 enters into a cut-off state and the drain D of the FET 11 enters into an open state. For a period of time during which the gate G of the FET 11 is at the ON voltage, therefore, the capacitor 13 is charged by a voltage of the source S and the voltage across the capacitor 13 is supplied to the gate G of the FET 12. A current based on the gate voltage and the source voltage flows from the drain D of the FET 12 to the source S via the organic EL device 15, thereby allowing the organic EL device 15 to emit light. When the gate G of the FET 11 is set to the OFF voltage, the FET 11 becomes open and the FET 12 holds the voltage at the gate G by the charges accumulated in the capacitor 13 and maintains the driving current until the next scan. The light emission of the organic EL device 15 is also maintained. The operation similar to that mentioned above can be executed even if the capacitor 13 is not provided, since a gate input capacitance exists between the gate G and source S of the FET 12.

The circuit corresponding to one pixel of the display panel for performing the light emission control by the active matrix driving is constructed as mentioned above and the light emission of the one pixel is maintained in the case where the organic EL device 15 of the pixel is driven.

FIG. 2 is a diagram showing a light emission characteristics curve of the organic EL device 15, namely, characteristics of a light emission luminance (L) and a current (I) against a voltage (V) applied to the EL device 15 are shown by using a temperature of the EL device 15 as a parameter. The light emission characteristics of the organic EL device 15 are similar to diode characteristics of an electronic device. When the applied voltage is smaller than a light emission threshold voltage Vth, the current I is extremely small. When the applied voltage becomes larger than the threshold voltage Vth, the current I suddenly increases. The current I and the luminance L are almost proportional. By applying the driving voltage exceeding the light emission threshold voltage Vth, the organic EL device 15 emits the light with luminance which is proportional to the current according to the applied driving voltage as mentioned above. With respect to a temperature dependency of the light emission characteristics of the EL device 15, when the temperature of the EL device 15 is high, the light emission threshold value Vth is small and a light emission efficiency (namely, gradient or slope of the light emission characteristics curve) is large. As the temperature decreases, the light emission characteristics deteriorate, the light emission threshold value Vth rises, and the light emission efficiency deteriorates.

Luminance gradations of each light-emitting device have been controlled by changing an amplitude of a luminance control signal to the gate G of the FET 12 in the active matrix light-emitting panel mentioned above, since the source-drain current of the FET 12 as a driving current of the organic EL device 15 changes in accordance with the applied voltage to the gate G of the FET 12. In general, a luminance control using a digital signal obtained by A/D converting an analog luminance control signal is performed.

OBJECTS AND SUMMARY OF THE INVENTION

In a display apparatus for amplitude modulating a luminance control signal to the driving devices as mentioned above to adjust the luminance, however, if the digital signal obtained by A/D converting the luminance control signal is used as a control signal to the gate G, the number of gradations which can be displayed also changes in accordance with a change in amplitude of the luminance control signal. Resolution of an A/D converter of the luminance control signal deteriorates and the number of gradations which can be displayed decreases in accordance with the decrease in the amplitude of the luminance control signal when decreasing the luminance of the light-emitting panel. Therefore, there arises such a problem that a multigradation display with a high precision is impossible.

The present invention is made in consideration of the above problem and it is an object of the invention to provide a display apparatus in which even in case of changing a display luminance of a light-emitting panel, the number of gradations which can be displayed is not limited and the luminance can be easily changed and a multigradation display with a high precision can be performed.

According to the present invention, there is provided an active matrix display apparatus comprising: a light-emitting panel including a plurality of light-emitting devices arranged in a matrix configuration and driving devices for selectively allowing each of the plurality of light-emitting devices to emit light; a control circuit for controlling the driving devices in accordance with an input video signal; a light adjustment signal generating circuit for generating a light adjustment signal to designate a display luminance of the light-emitting panel; and a variable power source for supplying electric power of a magnitude according to the light adjustment signal to the plurality of light-emitting devices.

According to another aspect of the present invention, the variable power source is a variable voltage source to generate a voltage which changes in accordance with a control signal.

According to another aspect of the present invention, the apparatus further comprises a temperature detector for detecting a temperature of an environment where the light-emitting panel is placed, and wherein the light adjustment signal generating circuit includes a correcting circuit for correcting the light adjustment signal in accordance with a detection signal from the temperature detector.

According to another aspect of the present invention, the apparatus further comprises a photometer for measuring a brightness of an environment where the light-emitting panel is placed, and wherein the light adjustment signal generating circuit includes a correcting circuit for correcting the light adjustment signal in accordance with a detection signal from the photometer.

According to another aspect of the present invention, a light emission period of the plurality of light-emitting devices is determined on the basis of a subfield $2^n$ gradation method.

According to the present invention, there is provided an active matrix display apparatus including a plurality of light-emitting devices arranged in a matrix configuration and driving devices for selectively allowing each of the plurality of light-emitting devices to emit light, comprising: a light adjustment signal generating circuit for generating a light adjustment signal to designate a display luminance of the display apparatus; and a voltage converting circuit for converting a predetermined voltage into a voltage of a magnitude according to the light adjustment signal and supplying the converted voltage to the plurality of light-emitting devices.

According to the present invention, there is provided an active matrix display apparatus including a plurality of light-emitting devices arranged in a matrix configuration and driving devices for selectively allowing each of the plurality of light-emitting devices to emit light, comprising: a voltage converting circuit for receiving a light adjustment signal to designate a display luminance of the display apparatus, converting a predetermined voltage into a voltage of a magnitude according to the light adjustment signal, and supplying the converted voltage to the plurality of light-emitting devices.

According to another aspect of the present invention, the plurality of light-emitting devices are organic electroluminescence devices.

DETAILED DESCRIPTION OF THE PREFERRED EMBODIMENTS

Figure 1:
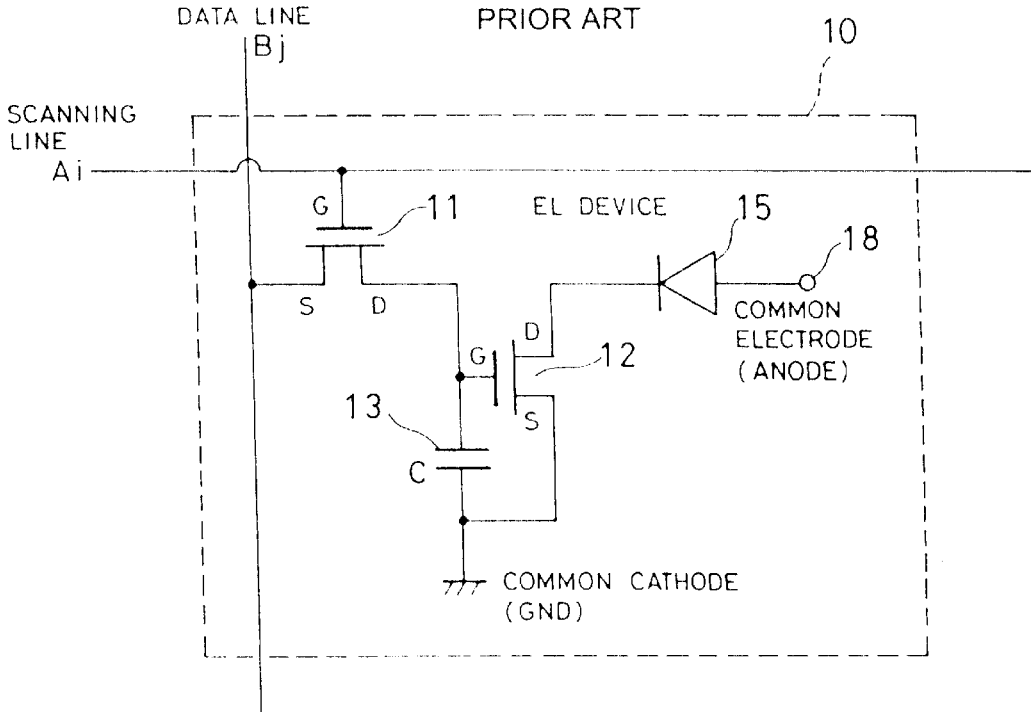
FIG.1 PRIOR ART
FIG. 1 is a diagram schematically showing an example of a circuit configuration corresponding to one pixel of a conventional active matrix light-emitting panel.
Figure 2:
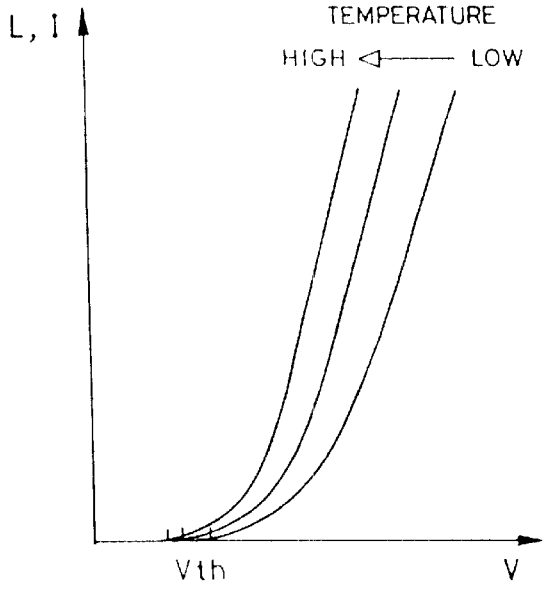
FIG.2 PRIOR ART
FIG. 2 is a diagram showing a light emission characteristics curve of an organic EL device, i.e., a light emission luminance (L) and a current (I) of an organic EL device against an applied voltage (V) are shown by using a temperature of the organic EL device as a parameter.

An embodiment of the present invention will be described in detail with reference to the drawings. In the drawings, which will be explained hereinbelow, substantially the same portions are designated by the same reference numerals.

Figure 3:
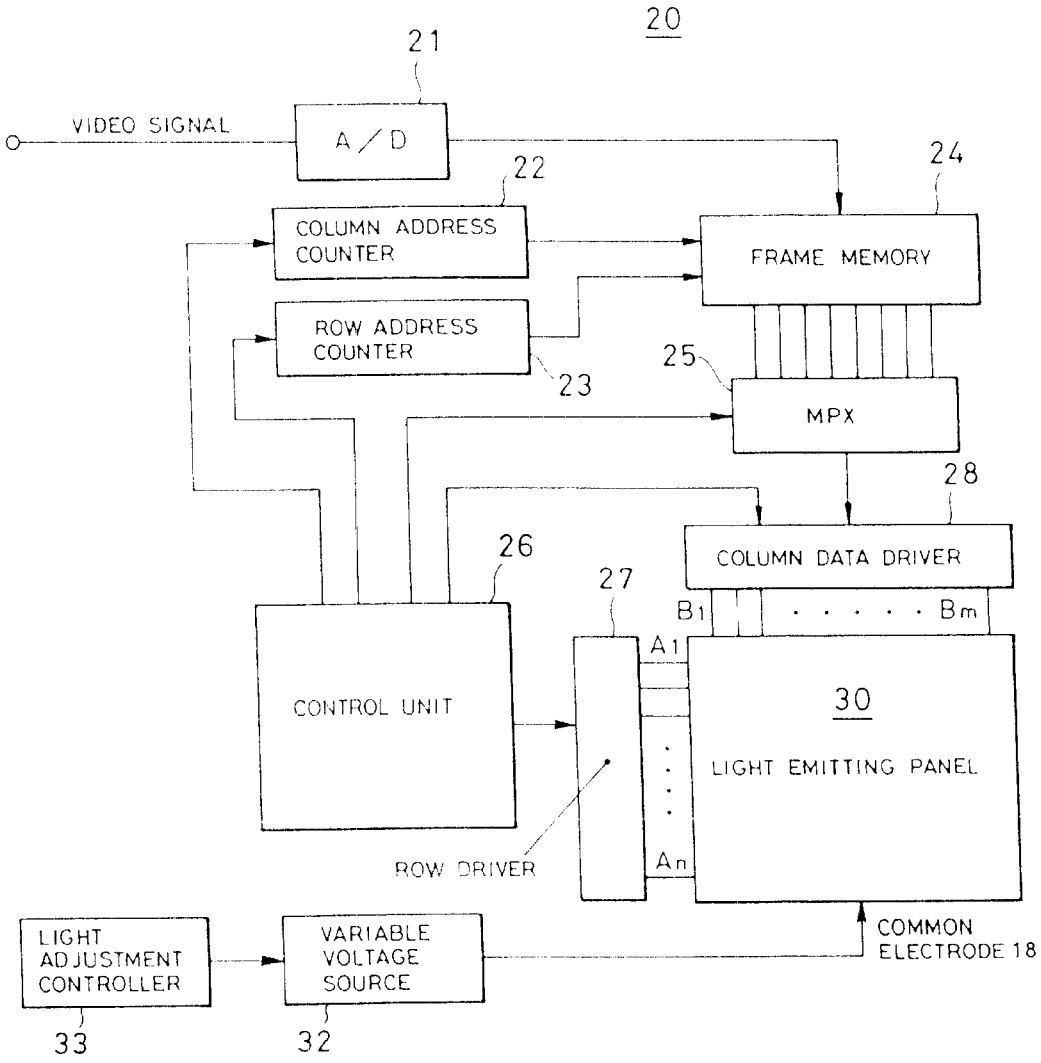
FIG. 3 is a diagram schematically showing a configuration of an organic EL display apparatus having an active matrix light-emitting panel according to the first embodiment of the invention.

FIG. 3 schematically shows a configuration of an organic EL display apparatus 20 using an active matrix light-emitting panel according to the first embodiment of the present invention.

In FIG. 3, an analog/digital (A/D) converter 21 receives an analog video signal input and converts into digital video signal data. A digital video signal obtained by the A/D conversion is supplied from the A/D converter 21 to a frame memory 24. The digital video signal data of one-frame unit is once stored in the frame memory 24.

A display control unit (hereinafter, simply referred to a control unit) 26 for controlling each section in the organic EL display apparatus 20 controls the digital video signal data stored in the frame memory 24 by using a column address counter 22 and a row address counter 23 on the basis of a plurality of subfields (a case of eight subfields will be described as an example hereinbelow) using different light emission times as parameters, thereby converting the video signal data into a plurality of (8, here) gradation display data and sequentially supplying the data to a multiplexer (MPX) 25 together with light emission/non-light emission data corresponding to addresses of pixels of a light-emitting panel 30, respectively.

The control unit 26 controls in such a manner that column data corresponding to each subfield in the light emission/non-light emission data supplied to the multiplexer 25 is sequentially held in a data latch circuit provided in a column driver 28 in arranging order of the pixels from the first row.

The control unit 26 supplies the column data of each subfield, which was sequentially held by the data latch circuit, to the light-emitting panel 30 on a row unit basis and allows a row driver 27 to simultaneously perform a light emission in the pixels within the corresponding row. The control unit 26 has a timer apparatus (not shown) therein and controls a light emission period of time of each pixel every subfield. The operation is performed on a data unit basis of one frame with respect to each column data of the first subfield to the eighth subfield. Each EL device 15 of the light-emitting panel 30 is controlled so as to emit light only for a predetermined light emission time period for each subfield, and a light emission screen display of one frame can be performed with a multigradation.

Figure 4:
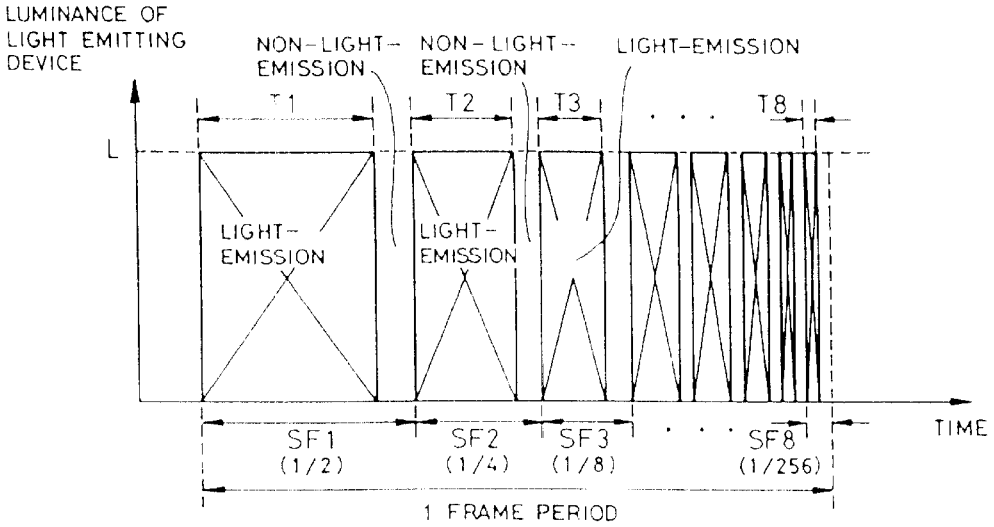
FIG. 4 is a diagram for explaining a $2^n$ subfield method as a method of controlling a luminance gradation of the light-emitting panel by a selective combination of subfields.

As shown in FIG. 4, in the embodiment, one frame period in the input video signal is divided into eight subfields (SF1 to SF8) and the subfields are set so that relative ratios of the luminances in the respective subfield periods (i.e., light emission periods T1 to T8 of each EL device 15 in the respective subfield time period) are sequentially equal to ½, ¼, ⅛, 1/16, 1/32, 1/64, 1/128, and 1/256 (i.e., $½^1$ to $½^8$) and controlled so that 256 kinds of luminance gradation displays can be performed by a selective combination of those subfields. That is, the luminance gradation is controlled by a method based on the subfield $2^n$ gradation method.

The image display apparatus using the subfield $2^n$ gradation method has been disclosed in, for example, Japanese Patent Application Kokai No.10-312173 by the same applicant as that of the present invention.

Figure 5:
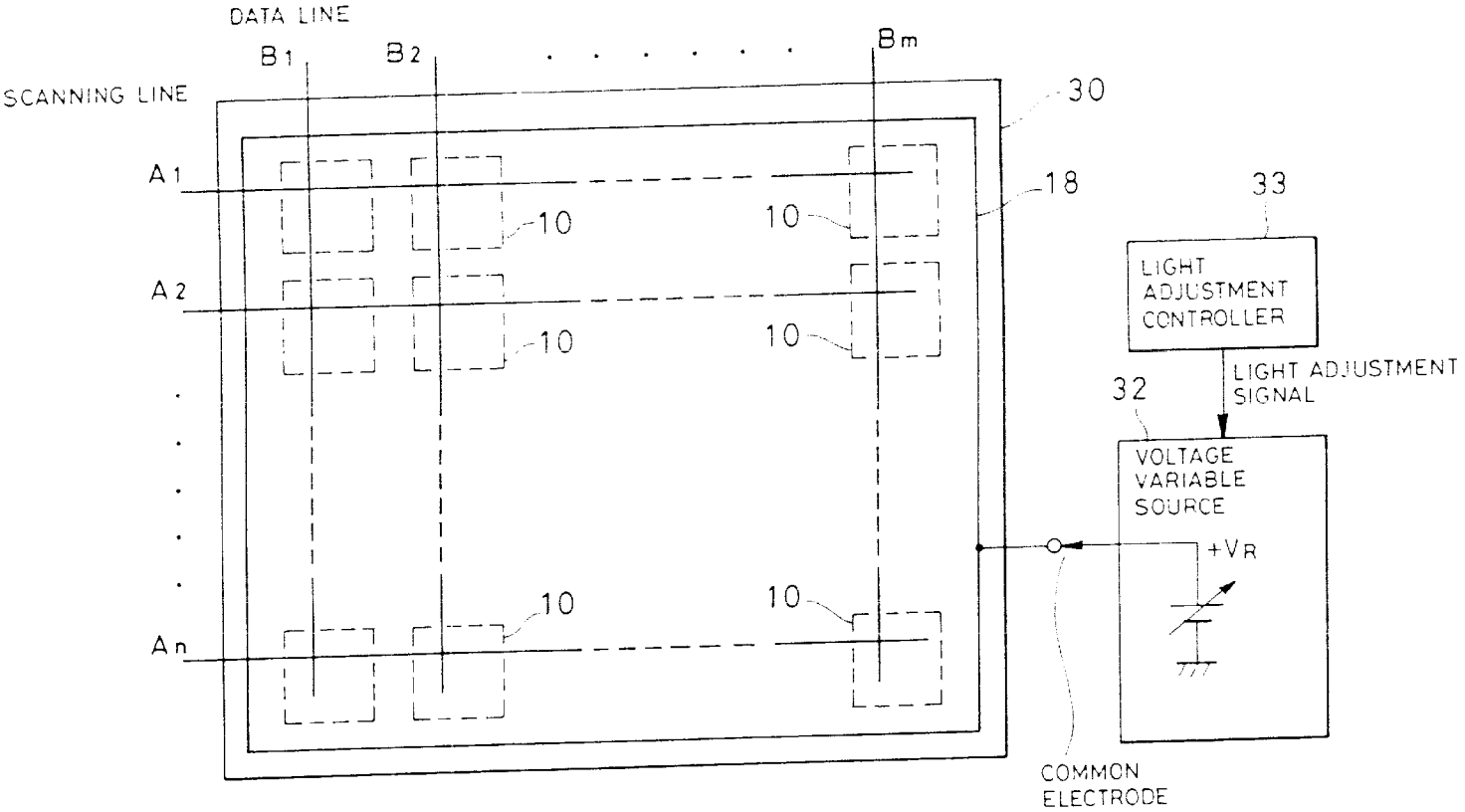
FIG. 5 is a diagram showing a configuration of a light adjustment controller and a variable voltage source in the organic EL display apparatus shown in FIG. 3.

A circuit configuration corresponding to one pixel (light-emitting unit) 10 of the light-emitting panel 30 is similar to that shown in FIG. 1. An anode of each EL device 15 in the light-emitting panel 30 is connected in common to a common electrode (common anode) 18. As shown in FIGS. 3 and 5, a variable voltage source 32 for supplying a voltage to allow the EL device 15 to emit the light is connected to the common electrode 18. The variable voltage source 32 generates a voltage which changes in accordance with a light adjustment signal from a light adjustment controller 33 connected to the variable voltage source 32. The light adjustment controller 33 is constructed by including, for example, a variable resistor (not shown) having a movable portion and a voltage across the variable resistor, of which resistance value varies by the operation of the movable portion by the user, can be used as a light adjustment signal. The light adjustment controller 33 can be a circuit for generating a pulse train, digital data, or the like, as a light adjustment signal, for designating a display luminance or a voltage supplied to the common electrode 18. The variable voltage source 32 can be also provided as a dedicated voltage source for driving the light-emitting panel 30 or can be also a voltage converting circuit for using a voltage from a power source of the whole display apparatus, converting the voltage in accordance with the light adjustment signal for outputting the converted voltage.

The organic EL display apparatus according to the present invention is constructed as mentioned above and can control the light emission luminance of the EL device 15 by changing the voltage to be supplied to each EL device 15 in the light-emitting panel 30 in accordance with the light adjustment signal from the light adjustment controller 33, so that the display luminance of the light-emitting panel 30 can be adjusted.

Figure 6A:
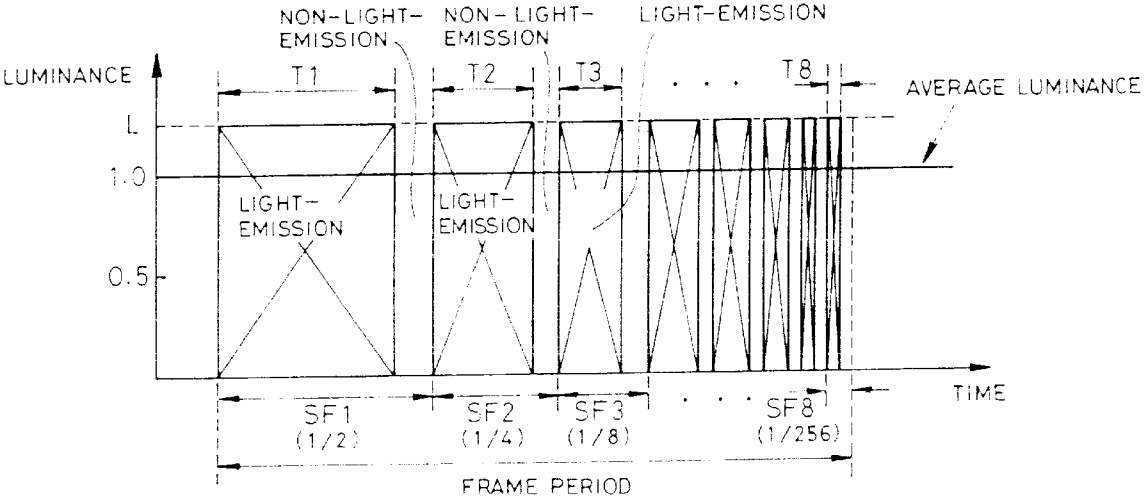
FIGS. 6A and 6B are diagrams each for illustrating a multigradation display in case of changing a display luminance of the light-emitting panel in the invention.
Figure 6B:
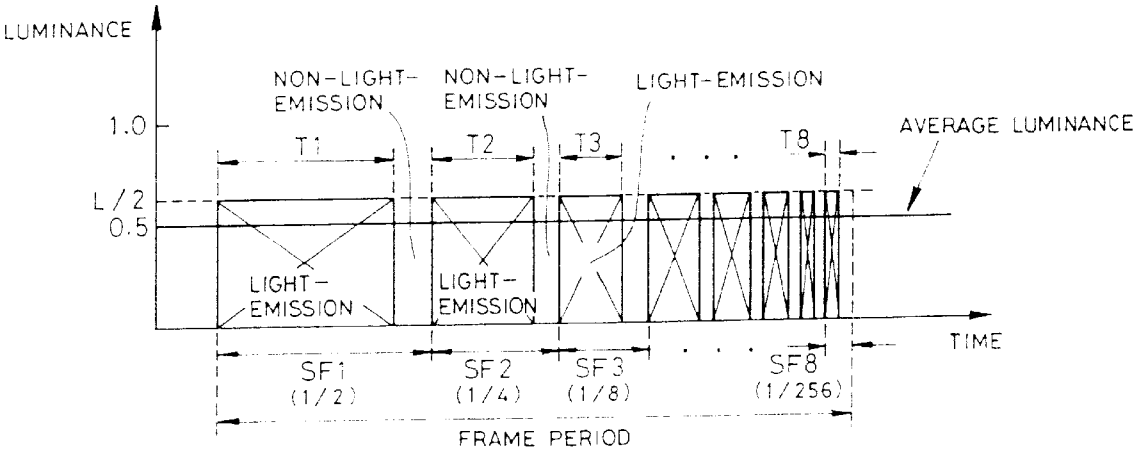

In the organic EL display apparatus according to the present invention mentioned above, even in case of changing the display luminance of the light-emitting panel 30, the number of gradations which can be displayed is not limited and a multigradation display with a high degree of precision can be performed. The description will be given hereinbelow in this regard. As shown in FIG. 6A, explanation will be made with respect to a case, as an example, where the light emission is controlled so that the light emission periods of the EL device 15 in the respective subfields (SF1 to SF8) are equal to T1 to T8 with respect to the one-frame period of the input video signal and a voltage such that the light emission luminance of the EL device 15 in each subfield is equal to L is applied to the common electrode of the EL device 15. The display luminance (i.e., average value of the light emission luminance in the frame period) of the light-emitting panel 30 in this case is normalized to 1.0. In the case where the light adjustment signal designating that the display luminance of the light-emitting panel 30 is reduced to, for example, ½ is generated, the voltage to be supplied to the EL device 15 is reduced in accordance with the light adjustment signal. In this instance, as shown in FIG. 6B, the luminances of the EL device 15 in all of the subfields (i.e., even for the subfield of the shortest period) are equal to L/2 and the display luminance is accurately reduced to 0.5. Even in case of reducing the light emission luminance of the EL device 15, the light emission luminance of the EL device 15 in each subfield is accurately reduced in accordance with the light adjustment signal at that time. Since the gradation display is performed by the selective combination of the respective subfields as mentioned above, according to the invention, the number of gradations is not limited by the level of the light adjustment signal and even in case of reducing the display luminance, a multigradation display with a high precision can be performed.

Figure 7:
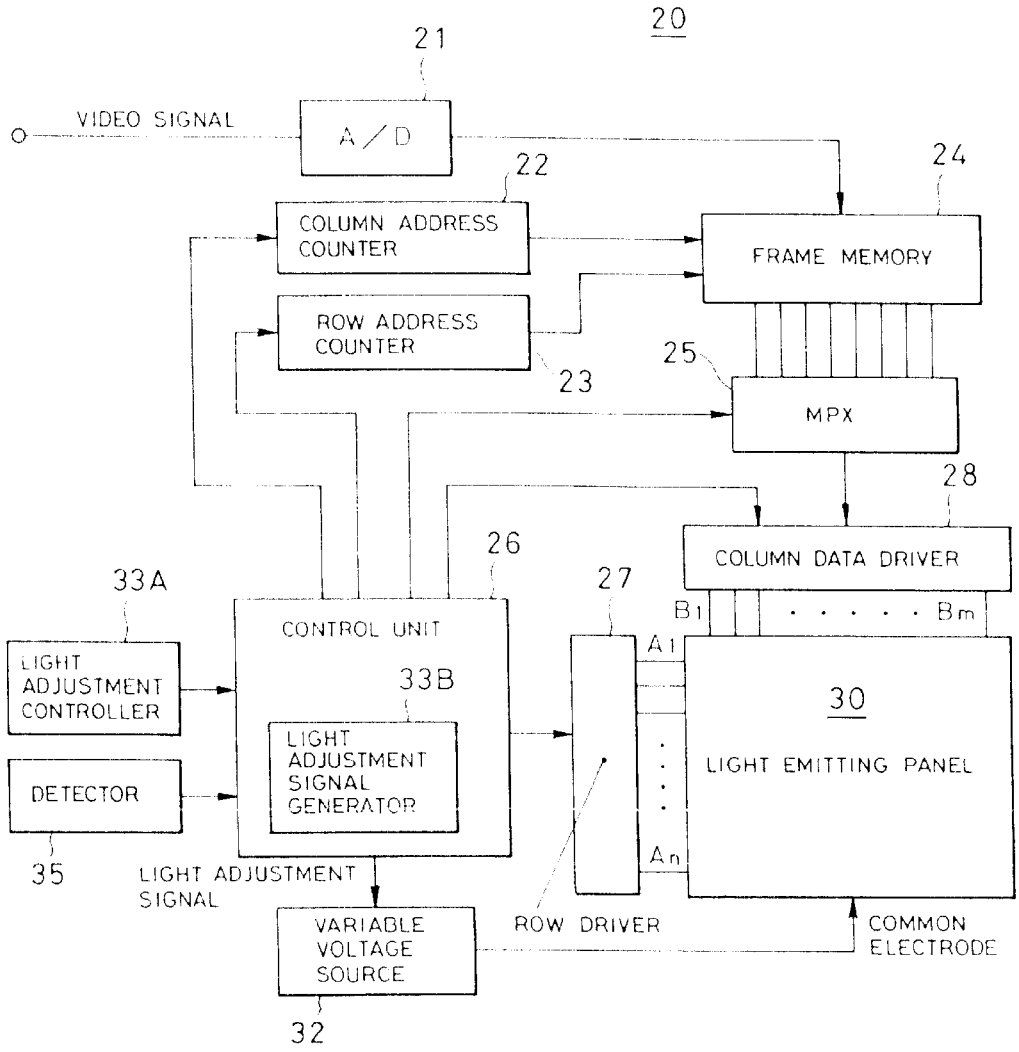
FIG. 7 is a diagram schematically showing a configuration of an organic EL display apparatus using an active matrix light-emitting panel according to the second embodiment of the invention.

FIG. 7 schematically shows a configuration of the organic EL display apparatus 20 using an active matrix light-emitting panel according to the second embodiment of the invention. The embodiment differs from the first embodiment with respect to points that a light adjustment row signal generating circuit 33B to generate the light adjustment signal is provided within the control unit 26 and a detector 35 connected to the control unit 26 is further provided. The control unit 26 receives a signal to designate the luminance from a light adjustment controller 33A, receives a detection signal from the detector 35, and generates the light adjustment signal to control a voltage of the variable voltage source 32 in accordance with the signals. The light adjustment controller 33A is constructed, for example, by including a variable resistor circuit having a movable portion (e.g., a slide control switch). The light adjustment signal generating circuit 33B generates the light adjustment signal corresponding to a voltage to be supplied to the light-emitting panel 30 on the basis of a voltage across the resistor (i.e., luminance designation signal) and the detection signal of the detector 35 under control of the control unit 26 and supplies the light adjustment signal to the variable voltage source 32.

The detector 35 is a temperature detector for detecting a temperature of an environment where the light-emitting panel is placed. The light adjustment signal generating circuit 33B adjusts the light adjustment signal so as to compensate the temperature dependency of the light emission characteristics of the EL device 15 mentioned above. In other words, for example, when the environmental temperature of the light-emitting panel is lower than a predetermined temperature, the temperature dependency is compensated so as to raise the voltage supplied to the light-emitting panel by a level corresponding to the decrease in temperature. On the contrary, when the environmental temperature is higher than the predetermined temperature, the temperature dependency is compensated so as to decrease the voltage supplied to the light-emitting panel by a level corresponding to the increase in temperature. By providing the light adjustment signal generating circuit 33B as mentioned above, even when the environmental temperature changes, the display luminance of the light-emitting panel can be held at a desired predetermined luminance without performing the adjustment of the light adjustment controller 33A.

The detector 35 may be a photometer for measuring a brightness of the environment where the light-emitting panel is placed. In this case, when the brightness of the environment of the light-emitting panel is lower than a predetermined brightness, the light adjustment signal generating circuit 33B compensates for the reduction of the brightness so as to reduce the voltage which is supplied to the light-emitting panel in accordance with the reduction of the brightness. When the brightness of the environment of the light-emitting panel is higher than a predetermined brightness, the light adjustment signal generating circuit 33B compensates so as to increase the voltage which is supplied to the light-emitting panel in accordance with the increase in the brightness. By providing the light adjustment signal generating circuit 33B, even in the case where the brightness of the environment changes, the display luminance of the light-emitting panel can be maintained to the luminance at which the user can easily see without performing the adjustment of the light adjustment controller 33A.

In the embodiment, the number of gradations is not limited and a multigradation display at a high precision can be performed even in a case of reducing the display luminance, since the display luminance of the light-emitting panel is controlled by the voltage supplied to the common electrode.

Figure 8:
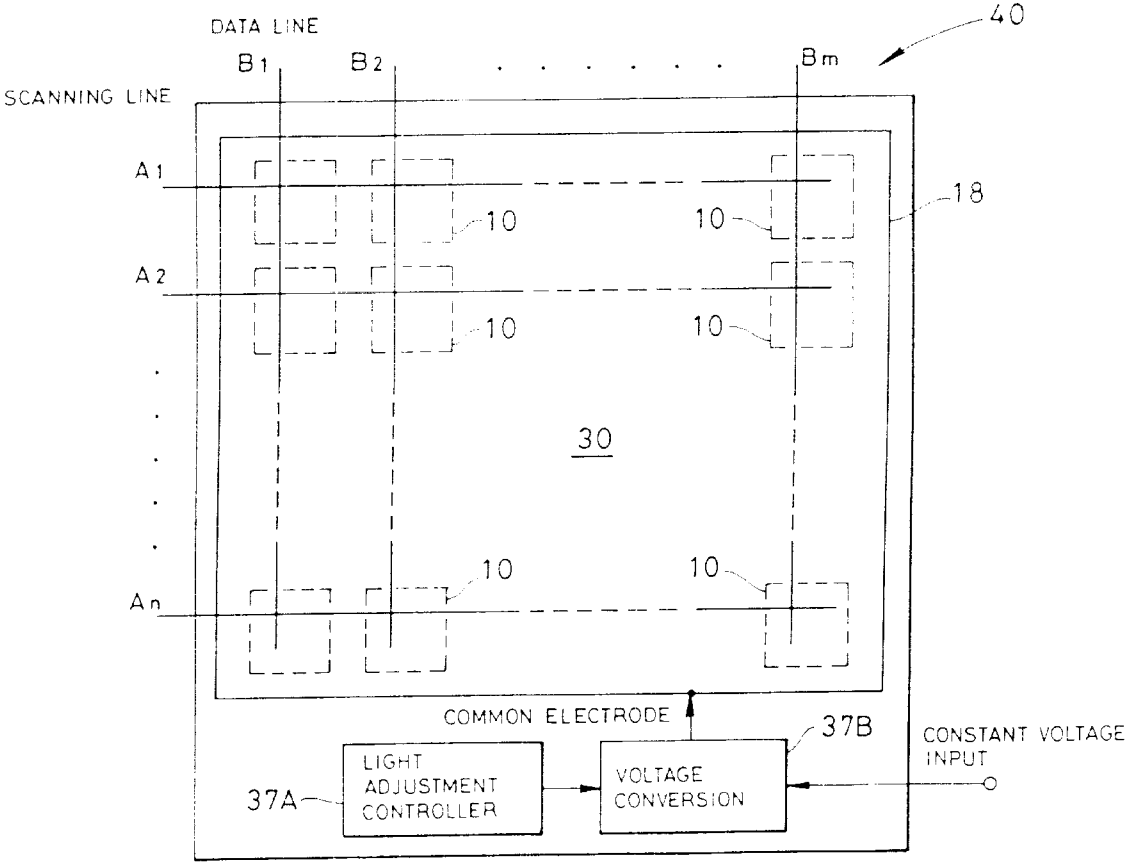
FIG. 8 is a diagram schematically showing a configuration of an active matrix light-emitting display according to the third embodiment of the invention.

FIG. 8 schematically shows a configuration of an active matrix light-emitting display 40 according to the third embodiment of the invention.

In the embodiment, the light-emitting display 40 has the light-emitting panel 30, a light adjustment controller 37A, and a voltage converting circuit 37B. The voltage converting circuit 37B has a signal input terminal for receiving the light adjustment signal from the light adjustment controller 37A and a voltage input terminal for receiving a predetermined voltage from an external power source. The voltage converting circuit 37B converts the input voltage in accordance with the light adjustment signal from the light adjustment controller 37A, and supplies the converted voltage to the common electrode 18 of the light-emitting panel 30.

The light adjustment controller 37A is constructed by including, for example, a variable resistor circuit having a movable portion and a voltage across the resistor, of which resistance value changes by the operation of the movable portion by the user, can be used as a light adjustment signal. The light adjustment controller 37A and voltage converting circuit 37B can be replaced with a voltage converting circuit in which they are integratedly formed and having a movable portion with which the converted output voltage can be changed by the user.

The light-emitting display 40 according to the present invention is constructed as mentioned above and the display luminance of the light-emitting panel 30 can be adjusted by changing the voltage supplied to each EL device 15 in the light-emitting panel 30 by the light adjustment controller 37A.

Also in the embodiment, the number of gradations is not limited and a multigradation display with a high precision can be performed even in a case of reducing the display luminance, since the display luminance of the light-emitting-panel is controlled by the voltage supplied to the common electrode.

Figure 9:
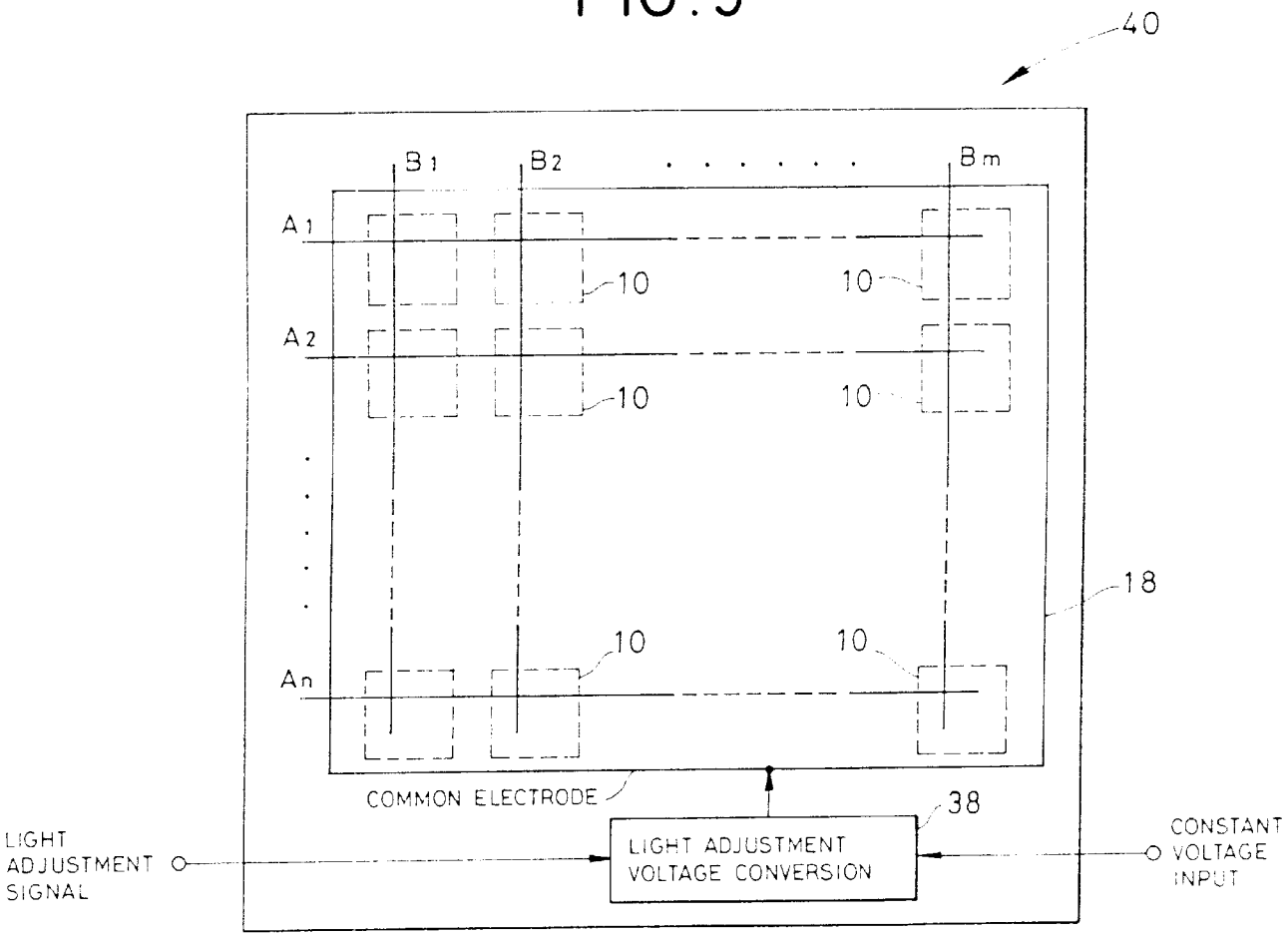
FIG. 9 is a diagram schematically showing a configuration of an active matrix light-emitting display according to the fourth embodiment of the invention.

FIG. 9 schematically shows a configuration of the active matrix light-emitting display 40 according to the fourth embodiment of the invention. The embodiment differs from the third embodiment in that the light-emitting display 40 has the light-emitting panel 30 and a light adjustment voltage converting circuit 38. The light adjustment voltage converting circuit 38 has a signal input terminal for receiving the light adjustment signal and a voltage input terminal for receiving a predetermined voltage from an outside source. The light adjustment voltage converting circuit 38 converts the input voltage in accordance with the supplied light adjustment signal, and supplies the converted voltage to the common electrode 18 of the light-emitting panel 30. The light adjustment voltage converting circuit 38 receives, for example, a pulse train, digital data, or the like for designating the display luminance of the light-emitting panel 30 or the voltage supplied to the common electrode 18 as a light adjustment signal and converts the voltage in accordance with the light adjustment signal.

Also in the embodiment, the display luminance can be controlled without deteriorating the multigradation display with a high precision, since the display luminance is controlled by the voltage supplied to the common electrode in a manner similar to the third embodiment.

It should be noted that the circuit configuration corresponding to one pixel 10 of the present invention is not limited to the configuration shown in FIG. 1 and various circuit configurations can be used.

As will be obviously understood from the above description, according to the present invention, the number of display gradations is not limited, since the display luminance of the light-emitting panel is controlled by the voltage supplied to the common electrode, even in a case of changing the display luminance. A display apparatus which can easily change the display luminance and can perform a multigradation display with a high precision can be realized.

The invention has been described with reference to the preferred embodiments thereof. It should be understood by those skilled in the art that a variety of alterations and modifications may be made from the embodiments described above. It is therefore contemplated that the appended claims encompass all such alternations and modifications.

What is claimed is:

1. An active matrix display apparatus comprising:

a light-emitting panel including a plurality of light-emitting devices arranged in a matrix configuration and driving devices for selectively allowing each of said plurality of light-emitting devices to emit light;

a control circuit for controlling said driving devices in accordance with an input video signal;

a light adjustment signal generating circuit for generating a light adjustment signal to designate a display luminance of said light-emitting panel; and a variable power source for supplying electric power of a magnitude according to said light adjustment signal to said plurality of light-emitting devices.

2. An apparatus according to claim 1, wherein said variable power source is a variable voltage source to generate a voltage which changes in accordance with a control signal.

3. An apparatus according to claim 1, further comprising a temperature detector for detecting a temperature of an environment where said light-emitting panel is placed, and wherein said light adjustment signal generating circuit includes a correcting circuit for correcting said light adjustment signal in accordance with a detection signal from said temperature detector.

4. An apparatus according to claim 1, further comprising photometer for measuring a brightness of an environment here said light-emitting panel is placed, and wherein said light adjustment signal generating circuit includes a correcting circuit for correcting said light adjustment signal in accordance with a detection signal from said photometer.

5. An apparatus according to claim 1, wherein a light emission period of said plurality of light-emitting devices is determined on the basis of a subfield $2^n$ gradation method.

6. An apparatus according to claim 1, wherein said plurality of light-emitting devices are organic electroluminescence devices.

7. An active matrix display apparatus including a plurality of light-emitting devices arranged in a matrix configuration and driving devices for selectively allowing each of said plurality of light-emitting devices to emit light, comprising:

a light adjustment signal generating circuit for generating a light adjustment signal to designate a display luminance of said display apparatus; and a voltage converting circuit for converting a predetermined voltage into a voltage of a magnitude according to said light adjustment signal and supplying the converted voltage to said plurality of light-emitting devices.

8. An apparatus according to claim 7, wherein said plurality of light-emitting devices are organic electroluminescence devices.

9. An active matrix display apparatus including a plurality of light-emitting devices arranged in a matrix configuration and driving devices for selectively allowing each of said plurality of light-emitting devices to emit light, comprising:

a voltage converting circuit for receiving a light adjustment signal to designate a display luminance of said display apparatus, converting a predetermined voltage into a voltage of a magnitude according to said light adjustment signal, and supplying the converted voltage to said plurality of light-emitting devices.

10. An apparatus according to claim 9, wherein said plurality of light-emitting devices are organic electroluminescence devices.

* * * * *